US006979247B1

(12) United States Patent
Ido

(10) Patent No.: US 6,979,247 B1
(45) Date of Patent: Dec. 27, 2005

(54) METHOD AND APPARATUS FOR GRINDING CAM WITH RE-ENTRANT SURFACE

(75) Inventor: Masahiro Ido, Kariya (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 0 days.

(21) Appl. No.: 11/188,738

(22) Filed: Jul. 26, 2005

(30) Foreign Application Priority Data

Jul. 28, 2004 (JP) ..... 2004-220701

(51) Int. Cl.[7] ..... B24B 1/00

(52) U.S. Cl. ..... 451/8; 451/5; 451/47; 451/72; 451/124; 451/178

(58) Field of Search ..... 451/5, 8, 28, 47–49, 451/52, 55, 72, 178, 150, 124, 407, 410; 125/11.16, 11.21, 11.23

(56) References Cited

U.S. PATENT DOCUMENTS 5,183,026 A * 2/1993 Ohta et al. ..... 125/11.16
5,562,523 A * 10/1996 Asano et al. ..... 451/1
6,200,200 B1 3/2001 Himmelsbach
6,390,892 B1 * 5/2002 Klicpera ..... 451/47
6,663,471 B2 * 12/2003 Kamamura et al. ..... 451/47

FOREIGN PATENT DOCUMENTS

JP 8-243906 9/1996

* cited by examiner

*Primary Examiner*—Lee D. Wilson
*Assistant Examiner*—Anthony Ojini
(74) *Attorney, Agent, or Firm*—Oblon, Spivak, McClelland, Maier & Neustadt, P.C.

(57) ABSTRACT

A workpiece W and a grinding wheel G are relatively moved in Z and X-axis directions perpendicular to each other, the rotational axis of the grinding wheel is inclined relative to the X-axis, and the grinding wheel is composed of a taper section Ga having a generating line parallel to the Z-axis and a spherical section Gb connecting with the generating line at the maximum diameter portion of the taper section Ga. While performing a cam profile generating motion, the grinding wheel is controlled to perform a plunge grinding feed toward the workpiece in the X-axis direction to effect a plunge grinding on the cam of the workpiece and then, while performing the cam profile generating motion, is controlled to perform a traverse grinding feed in the Z-axis direction to effect a traverse grinding on the cam.

5 Claims, 4 Drawing Sheets

METHOD AND APPARATUS FOR GRINDING CAM WITH RE-ENTRANT SURFACE

This application is based on and claims priority under 35 U.S.C. 119 with respect to Japanese Application No. 2004-220701 filed on Jul. 28, 2004.

BACKGROUND OF THE INVENTION

1. Field of the Invention

The present invention relates to a method and apparatus for grinding cams having a re-entrant surface with a grinding wheel.

2. Discussion of the Related Art

Heretofore, there has been known a method of grinding cams on a workpiece while the rotation about a C-axis of the workpiece carried on a workpiece support device and the feed in an X-axis direction of a wheel head carrying a grinding wheel are controlled by a numerical controller in a simultaneous two-axis control mode. In recent years, requirements in cam shape have become complicated and highly precise with the increase in performance of engines, and there is an increasing demand for cams with a re-entrant surface (A) as shown in FIG. 4. A small diameter grinding wheel which is able to contact with the re-entrant surface (A) is necessary in grinding cams having the aforementioned re-entrant surface. However, an interference takes place between the wheel head and the workpiece support device where the diameter of the grinding wheel is made to be small in the structure that the rotational axes for the workpiece and the grinding wheel are kept in parallel. To obviate this, in a cam grinding machine described in Japanese unexamined, published patent application No. 8-243906, a workpiece support device for supporting a workpiece and a wheel head carrying a grinding wheel are mounted to be movable respectively in Z and X-axis directions perpendicular to each other, a wheel spindle is mounted on the wheel head with its axis extending inclined with respect to the X-axis within an X–Z axis plane, and a small-diameter, tapered grinding wheel is mounted on one end of the wheel spindle to extend its generating line in parallel to the Z-axis.

Where a cam on a workpiece is ground by moving the grinding wheel back and forth in the X-axis in dependence on the rotational angle of the workpiece about the C-axis, in order that the grinding wheel with a predetermined diameter is able to contact with a desired cam shape at each rotational phase of the workpiece, the grinding wheel is given a plunge grinding feed toward the workpiece in the X-axis while the rotation about the C-axis of the workpiece and the movement in the X-axis of the wheel head are cooperated under the simultaneous two-axis control in accordance with cam profile generating NC data. In the cam profile generation motion, the point where the grinding wheel contacts with the desired cam shape moves up and down across a line segment connecting the rotational center of the workpiece with the rotational center of the grinding wheel, in dependence on the inclination angle of a common tangential line at the point. For this reason, where the grinding wheel has its diameter which differs from that set in preparing the cam profile generating NC data, an error occurs on the cam profile of the cam which is ground with the grinding wheel. For example, in the cam grinding apparatus in the aforementioned Japanese unexamined, published patent application No. 8-243906, where the cam profile generating NC data is prepared by taking as a predetermined diameter a nominal wheel diameter within a plane which is normal to the Z-axis at a center portion of the tapered grinding wheel and then, a plunge grinding is performed while the profile generating motion is given in accordance with the NC data, profile errors as shown in FIG. 5 are made on the ground cam shape due to the fact that the nominal diameter and the predetermined diameter differ at each of the small-diameter and large-diameter sides of the tapered grinding wheel.

In order to preclude the aforementioned profile errors, an attempt may be made in the cam grinding machine described in the aforementioned Japanese unexamined, published patent application No. 8-243906 to mount on an end of the wheel spindle a small-diameter spherical grinding wheel having its center on the axis of the wheel spindle and to make the wheel head perform a traverse grinding feed relative to the workpiece support device in the Z-axis direction while the workpiece and the wheel head perform the cam profile generating motion. However, where the attempt is made, the infeeding at the traverse feed end of the grinding wheel against the workpiece in the X-axis direction and the traverse grinding feeding have to be repeated many times, thereby resulting in a long grinding time.

SUMMARY OF THE INVENTION

Accordingly, it is a primary object of the present invention to provide an improved method and apparatus capable of grinding a cam having a re-entrant surface with a small-diameter grinding wheel precisely and efficiently.

Briefly, in one aspect of the present invention, there is provided a method of grinding a cam having a re-entrant surface on a workpiece through a cam profile generating motion which is performed under a simultaneous two-axis control involving the rotation of the workpiece about a C-axis within an X–Z plane and the movement of a wheel head relative to a workpiece support device in an X-axis direction in a grinding machine. In the grinding machine, the workpiece support device for supporting the workpiece and the wheel head carrying a grinding wheel are mounted on a bed to be movable relatively in Z and Y-axis directions perpendicular to each other, and a wheel spindle having the grinding wheel attached thereto is carried on the wheel head to be inclined relative to the X-axis within the X–Z plane. The method comprises the steps of composing the grinding wheel of a taper section having a generating line parallel to the Z-axis and being larger in diameter on a wheel head side and a spherical section connecting with the generating line at the maximum diameter portion of the taper section; performing a plunge grinding on the cam with the grinding wheel by causing the wheel head to perform, with the cam profile generating motion, a plunge grinding feed relatively toward the workpiece support device in the X-axis direction; and performing a traverse grinding on the cam after the plunge grinding by causing the wheel head to perform, with the cam profile generating motion, a traverse grinding feed relative to the workpiece support device in the Z-axis direction.

In another aspect of the present invention, there is provided an apparatus for grinding a cam having a re-entrant surface on a workpiece. In the apparatus, a workpiece support device for supporting the workpiece and a wheel head carrying a grinding wheel are mounted on a bed to be movable relatively in Z and X-axis directions perpendicular to each other, a wheel spindle having the grinding wheel attached thereto is carried on the wheel head to be inclined relative to the X-axis within an X–Z plane, and profile generation control means is provided for performing a cam profile generating motion between the workpiece and the grinding wheel under a simultaneous two-axis control involving the rotation of the workpiece given by the workpiece support device about a C-axis within the X–Z plane and the movement of the wheel head relative to the workpiece support device in the X-axis direction. The grinding wheel is composed of a taper section having a generating line parallel to the Z-axis and being larger in diameter on a wheel head side and a spherical section connecting with the generating line at the maximum diameter portion of the taper section. The apparatus further comprises plunge grinding feed control means for performing a plunge grinding on the cam with the grinding wheel by causing the wheel head to perform, with the cam profile generating motion controlled by the profile generation control means, a plunge grinding feed relatively toward the workpiece support device in the X-axis direction, and traverse grinding feed control means for performing a traverse grinding on the cam after the plunge grinding by causing the wheel head to perform, with the cam profile generating motion controlled by the profile generation control means, a traverse grinding feed relative to the workpiece support device in the Z-axis direction.

In the method and apparatus as constructed above, the workpiece and the grinding wheel are relatively moved in the Z and X-axis directions perpendicular to each other, the rotational axis of the grinding wheel is inclined relative to the X-axis, and the grinding wheel is composed of the taper section having the generating line parallel to the Z-axis and the spherical section connecting with the generating line at the maximum diameter portion of the taper section. While performing the cam profile generating motion, the grinding wheel is controlled to perform the plunge grinding feed toward the workpiece in the X-axis direction to effect the plunge grinding on the cam of the workpiece and then, while performing the cam profile generating motion, is controlled to perform the traverse grinding feed in the Z-axis direction to effect the traverse grinding on the cam. Thus, the cam of the workpiece can be efficiently ground with the taper section of the grinding wheel in the plunge grinding, and then, the cam can be ground with the spherical section of the grinding wheel in the traverse grinding without involving an error in cam profile due to the difference in the grinding wheel diameter. Accordingly, it can be realized to grind the cam efficiently and precisely.

BRIEF DESCRIPTION OF THE ACCOMPANYING DRAWINGS

The foregoing and other objects and many of the attendant advantages of the present invention may readily be appreciated as the same becomes better understood by reference to the preferred embodiment of the present invention when considered in connection with the accompanying drawings, wherein like reference numerals designate the same or corresponding parts throughout several views, and in which.

DETAILED DESCRIPTION OF THE PREFERRED EMBODIMENT

Figure 1:
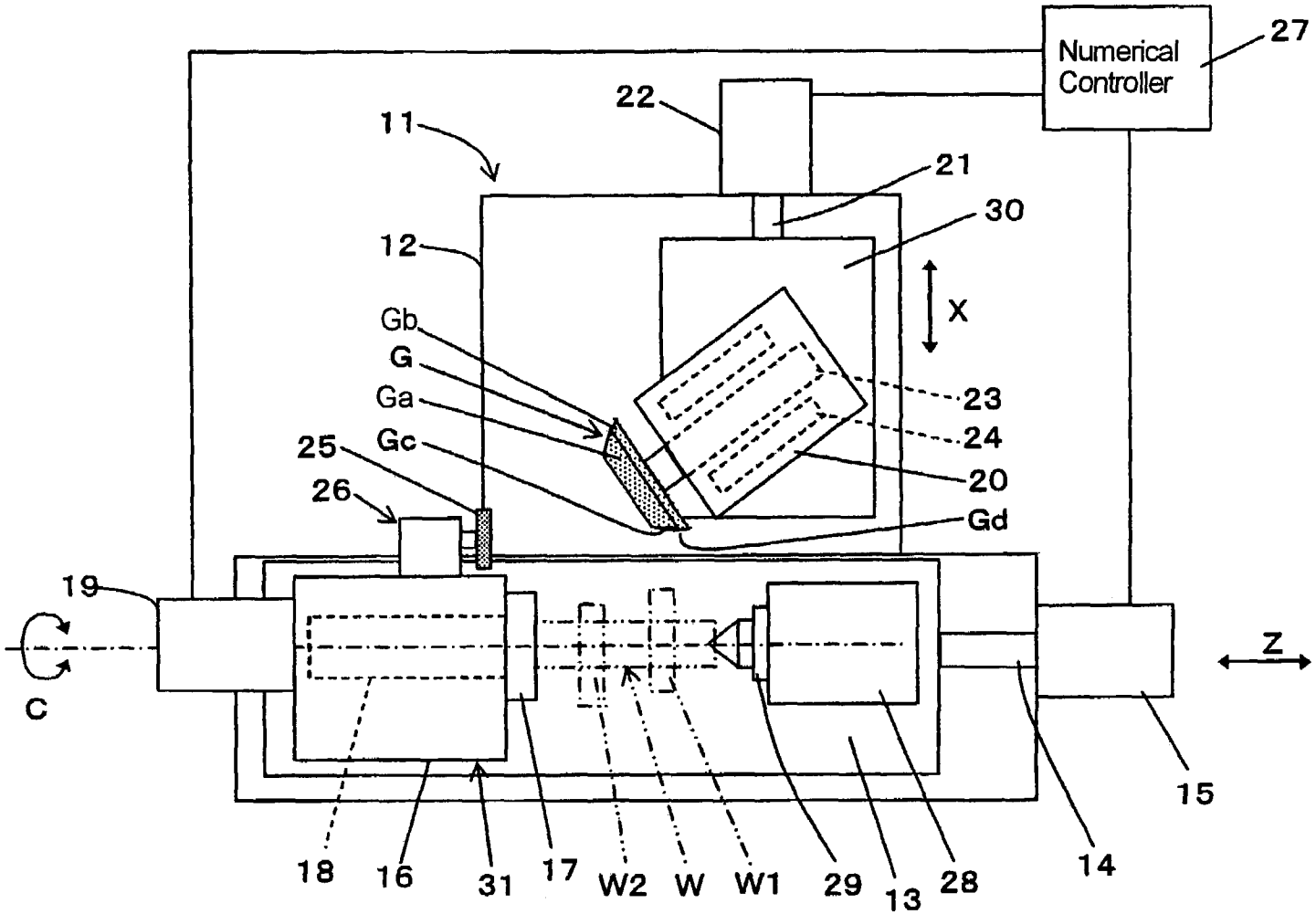
FIG. 1 is a schematic plan view of a numerical control cam grinding machine in one embodiment according to the present invention.

Hereafter, a method and apparatus for grinding a cam having a re-entrant surface in one embodiment according to the present invention will be described with reference to the accompanying drawings. Referring now to FIG. 1, a numerical control cam grinding machine 11 has a table 13 slidably mounted on a bed 12 thereof, and the table 13 is moved by a servomotor 15 through a ball screw 14 in a Z-axis direction. A work head 16 is fixed on the table 13, and a work spindle 18 for grasping one end of a workpiece W by a chuck 17 is rotatably carried on the work head 16 and is drivingly rotated by a servomotor 19 to rotate the workpiece W about a C-axis extending in parallel to the Z-axis. A foot stock 28 facing the work head 16 is fixed on the table 13 to be adjustable in position. The foot stock 28 fits therein a ram 29 to be slidable on the axis of the work spindle 18, and a center (not numbered) fixedly inserted into one end of the ram 29 is fit in a center hole formed at the other end of the workpiece W thereby to carry the other end of the workpiece W. The table 13, the work head 16, the servomotor 19 and the like constitute a workpiece support device 31 for supporting the workpiece W to be rotatable about the C-axis within a horizontal X–Z plane.

Figure 2:
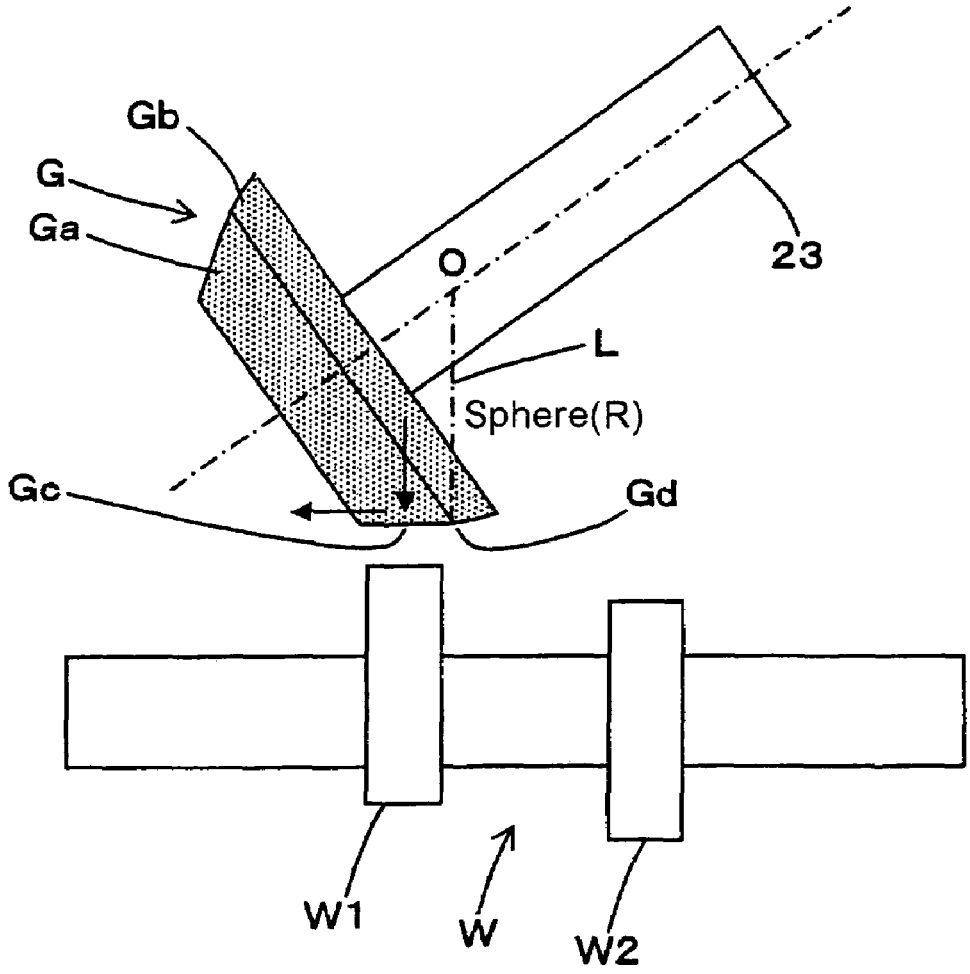
FIG. 2 is an explanatory view showing the shape of a grinding wheel and the relation between the grinding wheel and a workpiece.

On the bed 12, a wheel head table 30 is mounted slidably in an X-axis direction perpendicular to the Z-axis and is moved by a servomotor 22 through a ball screw 21 in the X-axis direction. A wheel head 20 is mounted on the wheel head table 30 to be inclined. A wheel spindle 23 is carried on the wheel head 20 to be inclined relative to the X-axis within the X–Z plane and is drivingly rotatable by a built-in motor 24. A grinding wheel G which is constructed so that an abrasive layer bonding CBN abrasive grains with a vitrified bond is adhered to an outer circumferential surface of a core member is attached to the wheel spindle 23. As shown in FIG. 2, the grinding wheel G is composed of a taper section Ga having a generating line Gc parallel to the Z-axis and becoming larger in diameter on the wheel head 20 side and a spherical section Gb connecting with the generating line Gc at the maximum diameter portion Gd of the taper section Ga. The center of the spherical section Gb coincides with an intersection (O) at which a line (L) drawn from the maximum diameter portion Gd of the taper section Ga in the X-axis direction intersects with the grinding wheel axis within the X–Z plane.

A truing device 26 which rotatably carries a truing roll 25 is fixed on the wheel head 20 side of the work head 16. When the table 13 and the wheel head 20 are relatively moved by the servomotors 15 and 22 which are operated under a simultaneous two-axis control in response to a command from a numerical controller 27, the taper section Ga and the spherical section Gb on the external surface of the grinding wheel G are trued with the truing roll 25.

In the numerical controller 27, there is stored, as profile generating means, cam profile generating NC data for rotating the servomotors 19 and 22 under a simultaneous two-axis control thereby to move the wheel head table 30 back and forth in the X-axis direction in connection with the rotational phase of the work spindle 18 about the C-axis within the X–Z plane so that a cam profile generating motion is performed between the workpiece W and the grinding wheel G. Further, in the numerical controller 27, there is stored as plunge grinding feed control means a plunge grinding feed program for giving the wheel head table 30 a plunge grinding feed towards the workpiece support device 31 in the X-axis direction in addition to the cam profile generating motion. Additionally, in the numerical controller 27, there is stored as traverse grinding feed control means a traverse grinding program for giving the table 13 a traverse grinding feed in the Z-axis direction by the servomotor 15 while causing the wheel head table 30 and the work spindle 18 to perform the cam profile generating motion.

The operation of the embodiment as constructed above will be described hereinafter. After the workpiece W is grasped by the chuck 17 of the work spindle 18 with the angular phase thereof being positioned in the rotation direction and has its rear end portion supported by being pushed by the center of the foot stock 28, an operation start switch is depressed, which causes the numerical controller 27 to execute the program shown in FIG. 3. Thus, the servomotor 15 is rotationally driven in response to a command from the numerical controller 27 to move the table 13 through the ball screw 14 in the Z-axis direction, whereby the taper section Ga of the grinding wheel G is relatively indexed to a grinding start portion where it faces a cam W1 to be first ground of the workpiece W (step S1).

Then, the servomotors 19 and 22 are rotated under the simultaneous two-axis control in accordance with the cam profile generating NC data, and the wheel head table 30 is moved back and forth in the X-axis direction in connection with the rotational phase of the work spindle 18 about the C-axis within the X–Z plane, whereby the cam profile generating motion is performed between the workpiece W and the grinding wheel G. At the same time, the servomotor 22 is rotated in synchronized relation with the rotation of the work spindle 18. This causes the wheel head table 30 to be advanced at a rough grinding feed rate toward the workpiece support device 31 in the X-axis direction until it reaches a rough grinding completion position, whereby the grinding wheel G is given a plunge rough grinding feed toward the workpiece W in the X-axis direction while being given the profile generating motion (step S2).

When the plunge rough grinding is completed as the result that the wheel head table 30 is advanced to the rough grinding completion position at the rough grinding feed rate, the grinding wheel G now being given the profile generating motion is further given a plunge fine grinding feed at a fine grinding feed rate toward the workpiece W in the X-axis direction until it reaches a fine grinding completion position, whereby the taper section Ga of the grinding wheel G performs a plunge fine grinding on the cam W1 (step S3).

For performing the plunge grinding on each cam of the workpiece W with the taper section Ga of the grinding wheel G, the steps S2 and S3 constitute the aforementioned plunge grinding feed control means which causes the wheel head 20 to perform the plunge grinding feed toward the workpiece support device 31 in the X-axis direction while causing the wheel head 20 to perform the cam profile generating motion in accordance with the cam profile generating NC data.

Upon completion of the plunge fine grinding, the servomotor 15 is rotated while the cam profile generating motion is being performed by the servomotors 19 and 22. Thus, the workpiece support device 31 is given a traverse grinding feed toward the left in the Z-axis direction, whereby the spherical section Gb of the grinding wheel G performs a traverse fine grinding on the cam W1 (step S4). During this traverse fine grinding feed, the cam W1 and the grinding wheel G continue the cam profile generating motion, so that a grinding point at which the grinding wheel G grinds the cam W1 is displaced up and down across the line connecting the rotational center of the workpiece W with the rotational center of the grinding wheel G. However, the spherical section Gb of the grinding wheel G has been formed to have the same diameter (2R) as a predetermined diameter of the grinding wheel which diameter was used in preparing the cam profile generating NC data. Therefore, even when the grinding point is displaced up and down within a plane which passes the spherical center (O) of the spherical section Gb and which is perpendicular to the Z-axis, the diameter of the grinding wheel G for grinding the cam W1 can be kept to be the predetermined diameter. Accordingly, it does not occur that an error in the cam profile is produced due to the difference in grinding wheel diameter. Further, since the spherical section Gb is given the traverse grinding feed from a position which is away from the right end of the cam W1 toward the right, toward the left with the small-diameter side of the taper section Ga preceding in the traverse feed grinding direction, the cam W1 can be ground with the spherical section Gb through the traverse fine feed precisely over the entire width thereof without involving a cam profile error due to the difference in the grinding wheel diameter. For performing the traverse grinding after the plunge grinding feed, the step S4 constitutes traverse grinding feed control means which causes the wheel head 20 to perform the traverse grinding feed relative to the workpiece support device 31 in addition to the cam profile generating motion.

Upon completion of the traverse fine grinding, the grinding wheel G is retracted from the advanced position to a retracted position in the X-axis direction while performing the profile generating motion, whereby the grinding wheel G is left from the cam W1 (step S5). Subsequently, the table 13 is moved in the Z-axis direction, so that the taper section Ga of the grinding wheel G is relatively indexed to a position where it faces another or second cam W2 next to the cam W1 of the workpiece W. With the indexing so performed, the aforementioned steps S1 through S5 are executed, whereby the cam W2 is ground. Since the wheel spindle 23 with the grinding wheel G attached thereto is carried to be inclined relative to the X-axis within the X–Z plane, it does not occur that the wheel head 20 interferes with the cam W1, the foot stock 28 or the like when the small-diameter grinding wheel G is advanced toward the workpiece W.

In the foregoing embodiment, after the plunge fine grinding, the cam W1 of the workpiece W is ground with the spherical section Gb through a traverse feed by effecting the traverse grinding feed of the grinding wheel G to make the small-diameter portion of the taper section Ga precede in the traverse feed grinding direction. Alternatively, after the plunge fine grinding, the grinding wheel G is retracted slightly from the workpiece W in the X-axis direction while performing the profile generating motion, the table 13 is then moved by the servomotor 15 toward the right to be indexed to a traverse start position where the right end of the spherical section Gb is slightly away from the left end of the cam W1, the wheel head table 30 is advanced by the servomotor 22 to a final finish position, and the table 13 is then moved toward the left, so that the grinding wheel G, while performing the cam profile generating motion, performs a traverse grinding feed to make the spherical section Gb precede in the traverse feed grinding direction.

In the foregoing embodiment, the workpiece support device 31 for supporting the workpiece W is mounted on the bed 12 through the table 13 to be moved in the Z-axis direction, and the wheel head 20 carrying the grinding wheel G is mounted on the bed 12 through the wheel head table 30 to be moved in the X-axis direction. Alternatively, the workpiece support device 31 is fixed on the bed 12, and the wheel head table 30 is mounted to be movable in the X-axis direction on a saddle which is mounted on the bed 12 to be movable in the Z-axis direction, so that the wheel head 20 is able to be moved not only in the X-axis direction but also in the Z-axis direction.

Further, in the foregoing embodiment, the taper section Ga of the grinding wheel G is wider in the Z-axis direction than the width of the cam W1, so that the plunge grinding at each of the steps S2 and S3 is able to cover the whole cam surface of the cam W1. However, where the width of the cam W1 is wider than the width of the taper section Ga of the grinding wheel G, on the contrary, a partial plunge grinding is performed, wherein the grinding wheel G is controlled to grind a part in the Z-axis direction of the cam W1 by causing the wheel head 20 to perform a plunge grinding feed relatively toward the workpiece support device 31 in the X-axis direction while performing the profile generating motion. Then, the partial plunge grinding is repeated each time the workpiece support device 31 is moved by a predetermined smaller amount than the width of the taper section Ga, relatively to the wheel head 20 in the Z-axis direction. As a result, another part on the cam surface of the cam W1 can be ground with the taper section Ga of the grinding wheel G. By further repeating the partial plunge grinding if need be, the whole cam surface of the wide cam W1 can be ground efficiently through two or more number of the partial plunge grindings.

Figure 3:
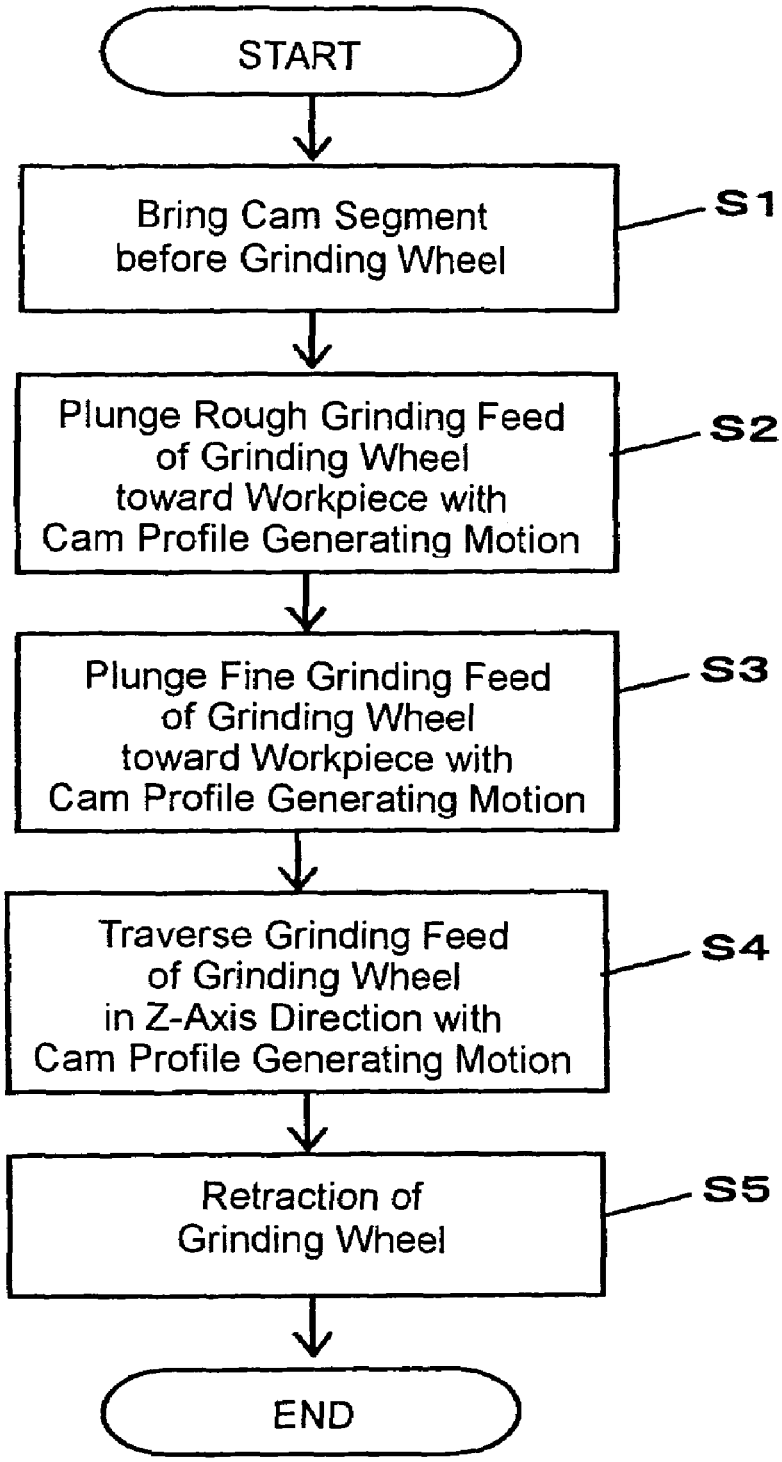
FIG. 3 is a flow chart showing a program for grinding a cam having a re-entrant surface.
Figure 4:
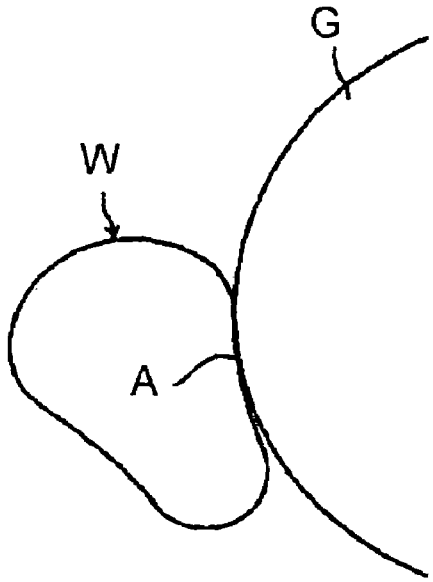
FIG. 4 is an explanatory view showing the state that the cam with the re-entrant surface is being ground.
Figure 5:
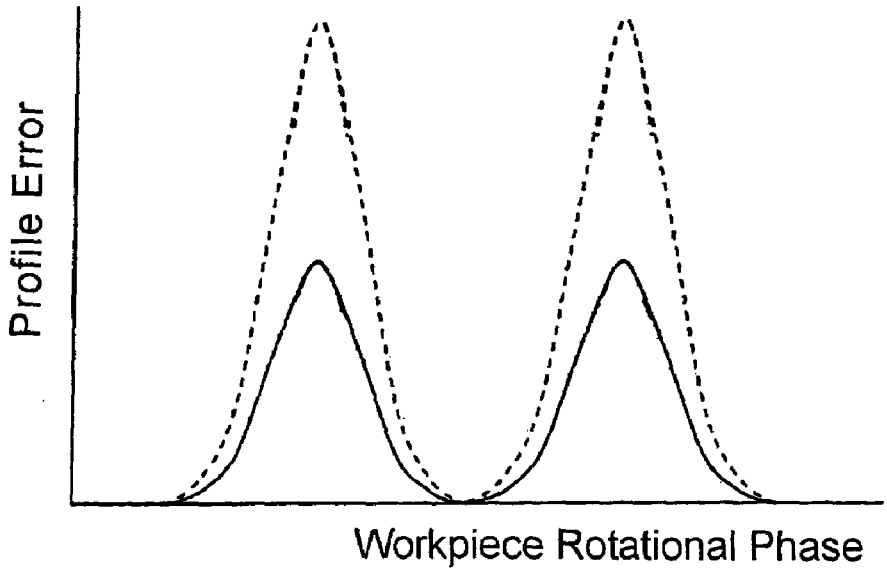
FIG. 5 is a graph showing profile errors produced by the difference in grinding wheel diameter.

Various features and many of the attendant advantages in the foregoing embodiment will be summarized as follows:

In the cam grinding method and apparatus in the embodiment typically shown in FIGS. 1 to 3, the workpiece W and the grinding wheel G are relatively moved in the Z and X-axis directions perpendicular to each other, the rotational axis of the grinding wheel G is inclined relative to the X-axis, and the grinding wheel G is composed of the taper section Ga having the generating line Gc parallel to the Z-axis and the spherical section Gb connecting with the generating line Gc at the maximum diameter portion Gd of the taper section Ga. While performing the cam profile generating motion, the grinding wheel G is controlled to perform a plunge grinding feed toward the workpiece W in the X-axis direction to effect a plunge grinding on the cam W1 of the workpiece W (steps S2 and S3) and then, while performing the cam profile generating motion, is controlled to perform a traverse grinding feed in the Z-axis direction to effect a traverse grinding on the cam W1 (step S4). Thus, the cam W1 of the workpiece W can be efficiently ground with the taper section Ga of the grinding wheel G in the plunge grinding (steps S2 and S3), and then, the cam W1 can be ground with the spherical section Gb of the grinding wheel G in the traverse grinding (step S4) without involving an error in cam profile due to the difference in the grinding wheel diameter. Accordingly, it can be realized to grind the cam W1 efficiently and precisely.

Also in the cam grinding method in the embodiment typically shown in FIG. 2, since while performing the cam profile generating motion, the grinding wheel G performs traverse grinding feed with the small diameter side of the taper section Ga of the grinding wheel G preceding in the traverse feed grinding direction, the traverse grinding feed is performed in succession to the plunge grinding feed, so that it can be realized to precisely effect the traverse grinding on the whole width of the cam W1 with the spherical section Gb of the grinding wheel G without involving an error in cam profile due to the difference in the grinding wheel diameter.

Also in the cam grinding method in a modified form of the embodiment, where the width of the cam W1 is wider than the width of the taper section Ga of the grinding wheel G, the partial plunge grinding with the cam profile generating motion is repetitively performed each time of shifting the grinding wheel G by a predetermined amount. Therefore, it can be realized to grind the wide cam W1 efficiently.

Obviously, further numerous modifications and variations of the present invention are possible in light of the above teachings. It is therefore to be understood that within the scope of the appended claims, the present invention may be practiced otherwise than as specifically described herein.

What is claimed is:

1. A method of grinding a cam having a re-entrant surface on a workpiece through a cam profile generating motion which is performed under a simultaneous two-axis control involving the rotation of the workpiece about a C-axis within an X–Z plane and the movement of a wheel head relative to a workpiece support device in an X-axis direction in a grinding machine wherein the workpiece support device for supporting the workpiece and the wheel head carrying a grinding wheel are mounted on a bed to be movable relatively in Z and X-axis directions perpendicular to each other and wherein a wheel spindle having the grinding wheel attached thereto is carried on the wheel head to be inclined relative to the X-axis within the X–Z plane, the method comprising the steps of:

composing the grinding wheel of a taper section having a generating line parallel to the Z-axis and being larger in diameter on a wheel head side and a spherical section connecting with the generating line at the maximum diameter portion of the taper section;

performing a plunge grinding on the cam with the grinding wheel by causing the wheel head to perform, with the cam profile generating motion, a plunge grinding feed relatively toward the workpiece support device in the X-axis direction; and performing a traverse grinding on the cam after the plunge grinding by causing the wheel head to perform, with the cam profile generating motion, a traverse grinding feed relative to the workpiece support device in the Z-axis direction.

2. The method as set forth in claim 1, wherein the traverse grinding feed is performed with a small diameter side of the taper section of the grinding wheel preceding in the traverse feed grinding direction.

3. The method as set forth in claim 2, wherein:

where the width of the cam is wider than the width of the taper section of the grinding wheel, a partial plunge grinding is performed with the grinding wheel on a part in the Z-axis direction of the cam by causing the wheel head to perform, with the cam profile generating motion, a plunge grinding feed relatively toward the workpiece support device in the X-axis direction; and the partial plunge grinding is then repeated each time the workpiece support device is moved by a predetermined smaller amount than the width of the taper section, relatively to the wheel head in the Z-axis direction.

4. The method as set forth in claim 1, wherein:

where the width of the cam is wider than the width of the taper section of the grinding wheel, a partial plunge grinding is performed with the grinding wheel on a part in the Z-axis direction of the cam by causing the wheel head to perform, with the cam profile generating motion, a plunge grinding feed relatively toward the workpiece support device in the X-axis direction; and the partial plunge grinding is then repeated each time the workpiece support device is moved by a predetermined smaller amount than the width of the taper section, relatively to the wheel head in the Z-axis direction.

5. An apparatus for grinding a cam having a re-entrant surface on a workpiece, wherein a workpiece support device for supporting the workpiece and a wheel head carrying a grinding wheel are mounted on a bed to be movable relatively in Z and X-axis directions perpendicular to each other, wherein a wheel spindle having the grinding wheel attached thereto is carried on the wheel head to be inclined relative to the X-axis within an X–Z plane, and wherein profile generation control means is provided for performing a cam profile generating motion between the workpiece and the grinding wheel under a simultaneous two-axis control involving the rotation of the workpiece given by the workpiece support device about a C-axis within the X–Z plane and the movement of the wheel head relative to the workpiece support device in the X-axis direction, wherein the grinding wheel is composed of a taper section having a generating line parallel to the Z-axis and being larger in diameter on a wheel head side and a spherical section connecting with the generating line at the maximum diameter portion of the taper section; and wherein the apparatus further comprises:

plunge grinding feed control means for performing a plunge grinding on the cam with the grinding wheel by causing the wheel head to perform, with the cam profile generating motion controlled by the profile generation control means, a plunge grinding feed relatively toward the workpiece support device in the X-axis direction; and traverse grinding feed control means for performing a traverse grinding on the cam after the plunge grinding by causing the wheel head to perform, with the cam profile generating motion controlled by the profile generation control means, a traverse grinding feed relative to the workpiece support device in the Z-axis direction.

* * * * *